US007967610B2

(12) United States Patent
Lynch et al.

(10) Patent No.: US 7,967,610 B2
(45) Date of Patent: Jun. 28, 2011

(54) CONNECTOR ASSEMBLY

(75) Inventors: Stephen Brian Lynch, Portola Valley, CA (US); Fletcher Rothkopf, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/210,968

(22) Filed: Sep. 15, 2008

(65) Prior Publication Data

US 2009/0180243 A1 Jul. 16, 2009

Related U.S. Application Data

(60) Provisional application No. 61/020,733, filed on Jan. 13, 2008.

(51) Int. Cl.
*H01R 12/00* (2006.01)

(52) U.S. Cl. ..... 439/60; 361/679.32; 361/724

(58) Field of Classification Search ..... 439/60; 361/679.32, 679.38, 724
See application file for complete search history.

(56) References Cited

U.S. PATENT DOCUMENTS

| | | | | |
|---|---|---|---|---|
| 6,005,768 | A * | 12/1999 | Jo | 361/679.34 |
| 6,062,887 | A * | 5/2000 | Schuster et al. | 439/218 |
| 6,264,488 | B1 * | 7/2001 | Helot et al. | 439/341 |
| 6,282,099 | B1 * | 8/2001 | Wilson et al. | 361/753 |
| 6,776,345 | B1 * | 8/2004 | Liang | 235/486 |
| 7,050,297 | B2 * | 5/2006 | Chung | 361/679.35 |
| 7,248,468 | B1 * | 7/2007 | Hsu | 361/679.33 |
| 7,405,928 | B2 * | 7/2008 | Robertson et al. | 361/679.33 |
| 7,432,867 | B2 * | 10/2008 | Wang et al. | 343/702 |
| 2006/0268528 | A1 * | 11/2006 | Zadesky et al. | 361/728 |

* cited by examiner

*Primary Examiner* — Truc T Nguyen
(74) *Attorney, Agent, or Firm* — Kilpatrick Townsend & Stockton LLP; David B. Raczkowski

(57) ABSTRACT

Methods and apparatus are provided for manufacturing a portable electronic device that does not cause yield loss or premature failure due a connector shell contacting the housing or its attached components during assembly. One example provides a connector shell that is split in at least two separate pieces or portions. A first piece of the connector shell is attached to a subassembly. A second piece of the connector shell is attached to or included as part of an endcap. During assembly, the subassembly and first connector shell piece is inserted into a housing from a first end. The endcap and the second piece of the connector shell can then be inserted into, or attached to, a second end of the housing.

43 Claims, 9 Drawing Sheets

CONNECTOR ASSEMBLY

CROSS-REFERENCES TO RELATED APPLICATIONS

This application claims the benefit of U.S. provisional application No. 61/020,733, filed on Jan. 13, 2008, entitled "Connector Assembly," by Lynch et al, which is incorporated by reference.

BACKGROUND

Portable electronic devices such as media players have become incredibly popular the past several years. To meet this demand, the number of types of devices has proliferated. Also, to meet consumer's demands for new products, improved versions of existing products are consistently being released. To keep pace, many different types, generations, and styles of devices need to be assembled and manufactured.

Portable electronic devices may have a connector to make electrical connections to host systems such as computers, dock stations, and the like. These device-side connectors may be in the form of a receptacle, and may include a shell portion and an electrode portion for making an electrical connection. The connector shell and electrode portions may be connected to the internal circuitry of the device. The connectors may take a variety of forms. Examples include USB, Firewire, and the 30 pin connector found in many iPods manufactured by Apple Inc of Cupertino Calif.

In recent years, portable electronic devices have become small, light and powerful. One factor contributing to this phenomenon is in the manufacturer's ability to fabricate various components of these devices in smaller and smaller sizes while in most cases increasing the power and or operating speed of such components. Unfortunately, the trend of smaller, lighter and powerful presents a continuing design challenge in the design and assembly of these devices. One design challenge is in techniques for mounting internal structures within these small form factor portable electronic devices. Often times, there is simply no space available to utilize conventional mounting techniques.

In view of the foregoing, there is a need for improvements in the manner in which structures are mounted within the enclosures of the portable electronic devices. For example, improvements that enable structures to be quickly and easily installed within the enclosure, and that help position and support the structures in the enclosure are desirable.

SUMMARY

Accordingly, embodiments provide an portable electronic device that has a connector shell that is split in at least two separate pieces or portions. One part is inserted into an enclosure from one end and the other part is inserted or attached from another end. Thus, the dimension (e.g. a profile) of at least one inserted part that is reduced, thus providing easier and more reliable insertion during assembly. Such a portable electronic device (e.g. a media player) advantageously reduces yield loss and premature failure due a connector shell contacting the media player housing or its attached components or circuitry during assembly. Similar methods may be applied to other parts of a portable electronic device.

According to an exemplary embodiment, a first piece of a connector shell is attached to a subassembly. A second piece of the connector shell is attached to an endcap. The second piece of the connector shell and endcap may be integrally formed and made of plastic, metal, or other material. During assembly, the subassembly and first piece of the connector shell is inserted into a housing from a first end. The housing may be a tube or other type housing.

In one embodiment, the tube or other type of housing is preassembled with certain components already attached to the housing. For example, a click wheel used to control the media player and/or a window for viewing a liquid crystal display (LCD) may be preassembled into the housing before insertion of the subassembly. In other embodiments of the present invention, the tube or other type of housing may include one or more buttons (e.g. as part of a keyboard), antennas, LCDs, touch-sensors, or other internal or external components, such as a joystick or a touchpad, and combinations thereof. The subassembly and first piece of the connector shell can be inserted into the housing without damaging the housing, the click wheel, window, buttons, antennas, LCDs, touch-sensors, or other associated components. The endcap and the second piece of the connector shell can be inserted into, or attached to, a second end of the housing.

In another embodiment, the first piece of the connector shell that is attached to the subassembly is a lower connector portion, while the second piece of the connector shell that is attached to or formed together with the endcap is an upper portion. In other embodiments of the present invention, the connector shell may be divided among a subassembly, endcap, housing, or other parts of the media player in various ways. Also, in some embodiments of the present invention, this endcap may be referred to as a bottom endcap. A top endcap may be attached to the subassembly. The top endcap may be attached to the subassembly before or after the subassembly is inserted into the housing.

Another exemplary embodiment of the present invention provides a connector shell that is attached to or formed together with the endcap. During assembly, the subassembly is inserted into a housing from a first end. The subassembly can be inserted into the housing without damaging the housing, the click wheel, window, buttons, antennas, LCDs, touch-sensors, or other associated components. The endcap and the connector shell can be inserted into, or attached to, a second end of the housing.

In another exemplary embodiment of the present invention, when a connector insert is inserted into a connector shell in a media player, a connector board is inserted into the connector insert. Pins on the connector board make contact with pins in the connector insert, thus forming an electrical connection. To provide mechanical stability for this connection, embodiments of the present invention may provide a connector shell having cutouts or slots into which tabs of a connector insert can fit. To ensure that the connector insert makes a reliable electrical connection when inserted, a specific embodiment of the present invention forms the cutouts on a portion of the connector shell that is also attached to the connector board. In other embodiments of the present invention, these cutouts may be on a portion of the connector shell attached to an endcap.

Another exemplary embodiment of the present invention provides one or more keys on the endcap or a portion of a connector shell. When a connector insert is inserted upside down, these keys block and provide tactile feedback to the user informing the user that the connector insert is being incorrectly inserted. Since alignment of these keys is not critical, they may be placed on the endcap or on a portion of the connector shell attached to the endcap.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
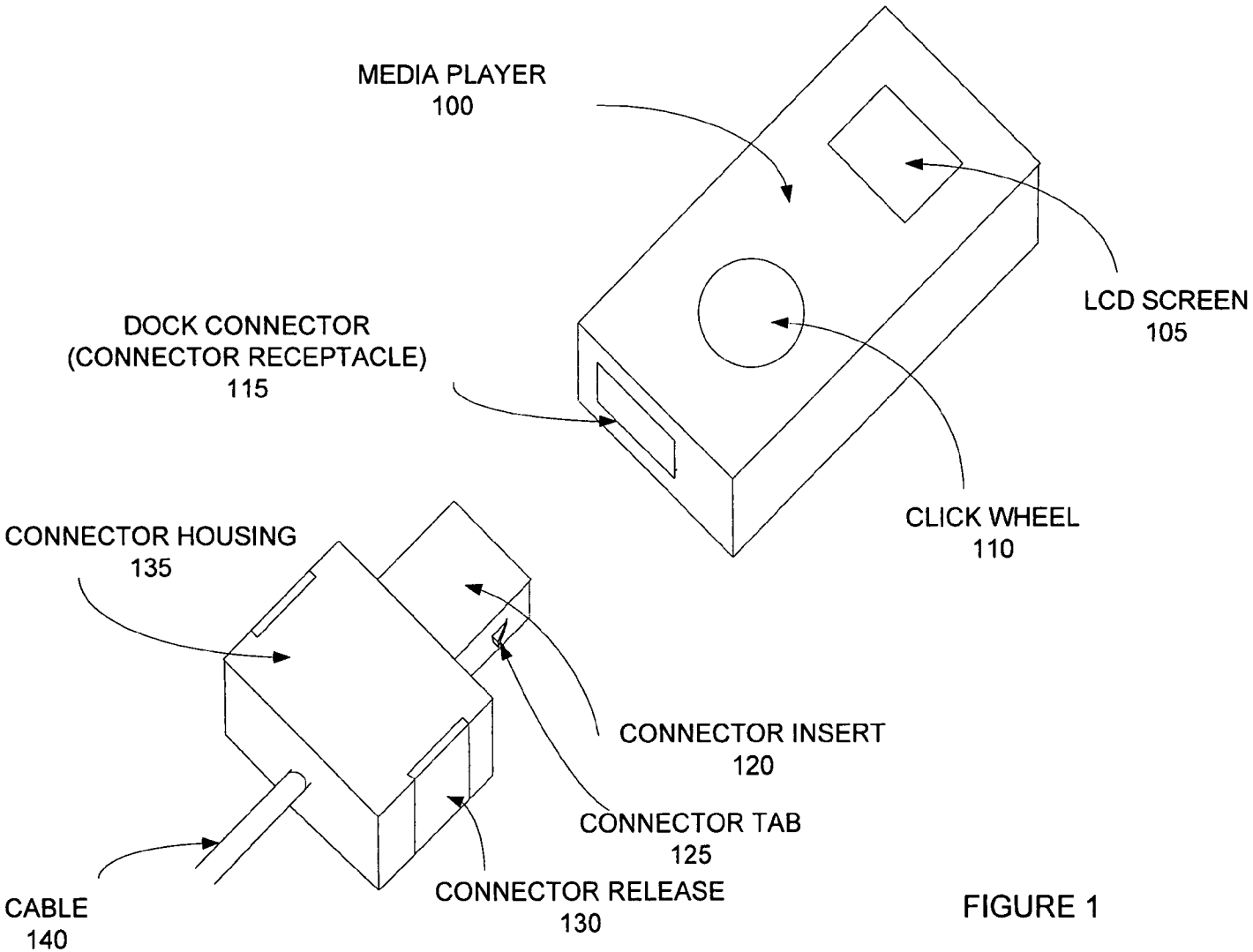
FIG. 1 illustrates a portable electronic device according to an embodiment of the present invention.

FIG. 1 illustrates a portable electronic device according to an embodiment of the present invention. This figure, as with the other included figures, is shown for illustrative purposes only and does not limit either the possible embodiments of the present invention or the claims.

This figure includes a media player 100 having an LCD 105 for viewing and a click wheel 110 for control. In one embodiment, the media player may include buttons, antennas, touch-sensors, or other internal or external components. The media player 100 further includes a dock connector (connector receptacle) 115.

The connector receptacle 115 is used to connect to host systems such as computers, dock stations, and the like. As depicted, the connector that is inserted into the connector receptacle 115 is part of a cable adapter having a housing 135 and cable 140. In other embodiments, the connector is part of a dock or other host, or any other type of external device.

A connector insert 120 is inserted into the dock connector 115. In one embodiment, the insert 120 includes connector tabs 125 on one or more sides that fit into slots on the connector receptacle 115. To remove the connector insert 120, the connector release buttons 130 are pushed and the connector insert it is withdrawn.

Typically, when a cable is used, the cable connects the media payer to a computer or other device. In this way, the computer can update media and other information on the media player, retrieve information, provide control, charge a battery on the media player, or provide or perform other functions. The media player may also attach to an accessory using the dock connector. This connection allows the accessory to pass and receive information to the media player, charge a battery on the media player, and perform or provide other functions.

Various embodiments of the present invention may employ different physical connectors. An example of one such connector is the 30-pin connector disclosed in copending U.S. application Ser. No. 10/423,490, titled Media Player System, which is incorporated by reference. In other embodiments of the present invention, the connector may be another type of connector, such as a USB, FireWire, serial, parallel, or other type of connector.

Embodiments provide a media player (or any other portable electronic device) that is small (e.g. thin), but which may be assembled more easily and with a lower chance of error than previous media players.

Figure 2A:
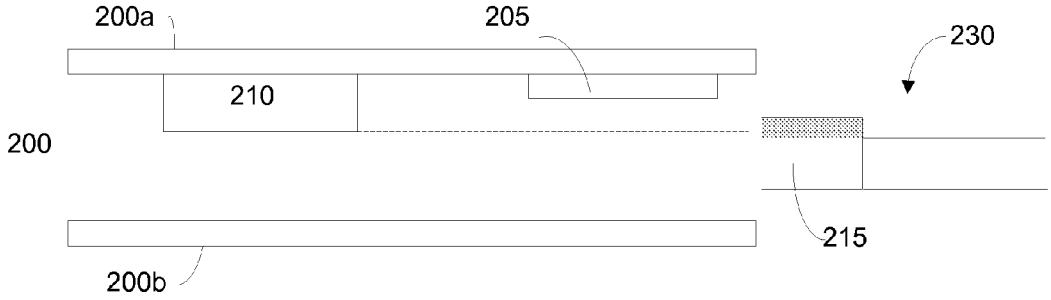
FIG. 2A shows a simplified cross-sectional view of a housing of a portable electronic device.

FIG. 2A shows a simplified cross-sectional view of a housing 200 of a portable electronic device. A display window 205 and a user interface (e.g. a clickwheel) 210 are shown.

There are many ways to produce housings of portable electronic devices. In some portable electronic devices, the enclosures are mechanical assemblies having multiple parts that are screwed, bolted, riveted, or otherwise fastened together at discrete points. For example, the enclosures may include an upper casing 200*a* and a lower casing 200*b* that are placed on top of one another and fastened together using screws. The upper and lower casing may take a variety of forms. In some cases, the upper and lower casings form a tube like enclosure that is further sealed by top and/or bottom end caps.

In other portable electronic devices, in order to reduce undesirable cracks, seams, gaps and breaks of mating surfaces found between upper and lower casings, the tube like enclosure may be integrally formed as a single part. The integrally formed part may have a pair of open ends that are closed off with end caps. In one embodiment, the tube like enclosure extends longitudinally along its axis. In one embodiment, the longitudinally extending enclosure includes open ends at either side. In one embodiment, the longitudinally extending enclosure has width dimensions and height dimensions that are significantly larger than its thickness thereby making a very thin device. In one embodiment, the enclosure is formed via an extrusion process. Examples of enclosures such as these may be found in U.S. patent application Ser. Nos. 10/884,172 and 11/501,184, which are herein incorporated by reference.

In tube like enclosures, the portable electronic device may be assembled by inserting the internal circuitry and systems into the enclosure through one or both of the open ends. For example, internal circuitry may be slid into the enclosure through the open ends and accurately positioned therein. This assembly technique provides some advantages. For example, the internal circuitry and systems can be assembled and connections can be made outside the enclosure where there is more space. As should be appreciated, it is much easier to make complex electrical connections where there is space (e.g., video connections, battery connections, etc.).

Unfortunately, in small form factor devices (e.g., very thin), there might not be enough room for insertion of internal circuitry and systems such as circuits, boards, and various electronic subassemblies, for example, due to their z stack. The z stack here is the direction that is normal (i.e. perpendicular to the surface) to the upper casing 200*a*, the lower casing 200*b*, or both. For example, although the device may have enough room inside its enclosure for a subassembly 230, a first placed component, such as a subassembly (e.g. display 205 and clickwheel 210), may become an obstruction to the subsequently inserted component or sub assembly (or alternatively internal features of the housing may form obstructions).

In one example, a subassembly may strike or otherwise come in contact with the housing 200 or other internal circuitry of the device during insertion into the enclosure. For example, a connector 215, may strike the clickwheel 210. This obstruction or striking may prevent final assembly or otherwise damage the parts. Damage may cause yield loss during the manufacturing process. Damage may also go unnoticed yet cause premature failure of the device. To cure this problem, embodiments break up the connector into multiple portions in order to allow proper insertion into the enclosure.

In one embodiment, the electronic subassembly includes a component that forms a final z height (e.g. the connector). As shown, the final z height of the connector is the vertical position of the final product, which is approximately in the middle. As shown in FIG. 1A, the final z height of the connector as a whole is too large to be fully assembled through a single open end and into its final position within the enclosure. By way of example, the connector as a whole may form one of the highest points of the z stack of the subassembly. Although the subassembly 230 could be lowered during insertion, a final desired position of the connector would have to be raised, which adds complexity to the manufacturing process. In other embodiments, the subassembly 230 may be too large to be inserted, even if lowered almost against the lower casing 200*b*.

Figure 2B:
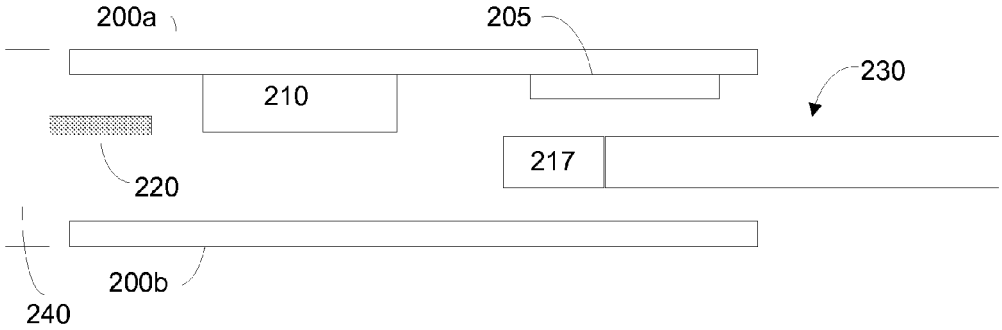
FIG. 2B shows a cross-sectional view of a portable electronic device being constructed according to an embodiment of the present invention.

FIG. 2B shows a cross-sectional view of a portable electronic device being constructed according to an embodiment of the present invention. In order to assemble the electronic sub assembly into the enclosure of the portable electronic device, the height of the connector 215 is reduced (e.g., a low profile component is produced). As shown in FIG. 2B, this may be accomplished by separating the connector into a first lower portion 217 and a second upper portion 220. The first lower portion 217 is connected to the electronic sub assembly and is inserted into the enclosure through a first open end of the enclosure, and the second upper portion 220 is removed from the sub assembly and is inserted through a second open end of the enclosure. The second end is opposite the first end. The first and second portions are reconnected inside the device thereby forming a final connector.

Figure 2C:
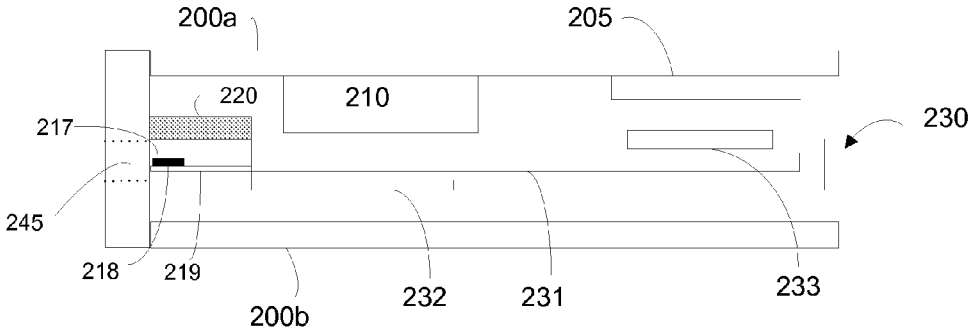
FIG. 2C shows a cross-sectional view of a portable electronic device constructed according to an embodiment of the present invention.

FIG. 2C shows a cross-sectional view of a portable electronic device constructed according to an embodiment of the present invention. After insertion, the second upper portion 220 is reunited with the first lower portion 217 thereby forming the final assembly of the connector. The first and/or second portions may include features that allow the two parts to be properly aligned and connected in their assembled position within the housing. As shown, this configuration allows a large z stack with less available z space. There is enough room for the second portion 220 through the second end and enough space for the first portion 217 through the first end (but as mentioned not enough space for both parts together through a single end).

In one example, the z height of a component (e.g. the connector) is reduced to the next highest component of the subassembly. By way of example, at least the top 10% of the connector is removed (e.g., upper portion forms 10% of the height and the lower portion forms 90% of the height). In another example, at least the top 25% of the connector is removed. In yet another embodiment, at least the top 50% of the connector is removed. The percentage may be dependent on the Z space available for insertion of the sub assembly.

Although the invention is directed at z dimension, it should be appreciated that this is not a limitation and that the invention can be directed at other dimensions as well as multiple dimensions (e.g., x and/or y and/or z).

It should also be appreciated that the invention is not limited to first and second parts, and that more parts may be utilized in the dimension specified and/or in alternate dimensions. With regards to the first example, the first and/or second portions may be further broken up into multiple parts. They may be assembled in a similar plane and/or they may be offset depending on the configuration of the parts. By way of example, the first and second parts may be assembled together although separate pieces, or alternatively they may be assembled in a sequential order, i.e., first part then second part (similar to a 3 dimensional puzzle).

In accordance with one embodiment, the second portion may be associated with a structural element of the connector thereby leaving the electrical connections (e.g., included in the lower portion) with the sub assembly. The structural element may for example correspond to a shell that surrounds, covers and/or protects, completely or partially, electrical systems of the connector. In one implementation, the second portion may be integrated into a housing system of the enclosure. For example, it may be integrated with an end cap 240 that closes off the opposing end of the enclosure. In one example, the second portion is integral with the end cap. In another example, the second portion is simply attached to the end cap thereby forming a final assembly. By way of example, it may be press fit, glued, screwed or otherwise attached to the end cap. The first portion 217 may include pin contacts 218 connected with a circuit board 219 containing electronic circuits. In the embodiment shown, endcap 240 can have an opening 245 through which a connector insert can be inserted to connect with pin contacts of first portion 217, as is depicted in FIG. 1 with connector insert 120 being connected with connector receptacle 115 through the opening shown. Subassembly 230 can include a connector shell portion 217, printed circuit board 231, battery 232, and liquid crystal display (LCD) 233.

In one embodiment, the entire structural element of the connector is separated from the electronics/circuitry. In another embodiment, only a portion of the structural element is separated from the electronics/circuitry. By way of example, the portion may be the portion that creates z stack interference during insertion. In one particular embodiment, the separated portion of the structural element is made to form or integrated with a portion of the enclosure of the portable electronic device. In this manner, the structural part of the component is made part of the housing (another structural system) and the electronics/circuitry are connected to the electronics/circuitry inside the enclosure. The electronics/circuitry may for example be offloaded to a circuit board, while the structural element is offloaded to the enclosure.

In one embodiment, the connector that makes up part of a sub-assembly. The sub-assembly may include such components as circuit boards, batteries, and I/O (e.g., display) all of which are connected outside the enclosure before insertion therein (e.g., each component is connected to the circuit board, which provides a central interface for the electronic components.

In this embodiment, the connector includes an outer shell and an inner electrode. The outer shell is typically configured to surround the inner electrode. Thus, it serves as a structural feature of the connector. It may also serve some electrical functions such as grounding/shielding. The inner electrode typically includes various pins and contacts that provide a connection interface. The connection interface may include data, power and the like.

The inner electrode, and specifically its pins/contacts are typically attached to the circuit board of the subassembly. In some cases, the outer shell is spaced apart from the inner electrode thus further increasing the z height of the connector. In one implementation, the entire outer shell is removed from the connector thereby decreasing the z height. In another implementation, only a portion of the outer shell is removed from the connector. For example, the size of the removed portion may provide a z stack for the connector that allows the subassembly to be easily and correctly placed within the enclosure without impediment. In either implementation, the removed portion of the connector is subsequently reunited with the remaining portion of the connector from the opposing side of the enclosure. That is, removed portion is placed correctly relative to the remaining portion thereby forming the final connector assembly. Again, as mentioned, the removed portion may form or be integrated with the enclosure of the device. For example, it may be made part of the end cap that closes the end of the tube like enclosure.

Figure 3:
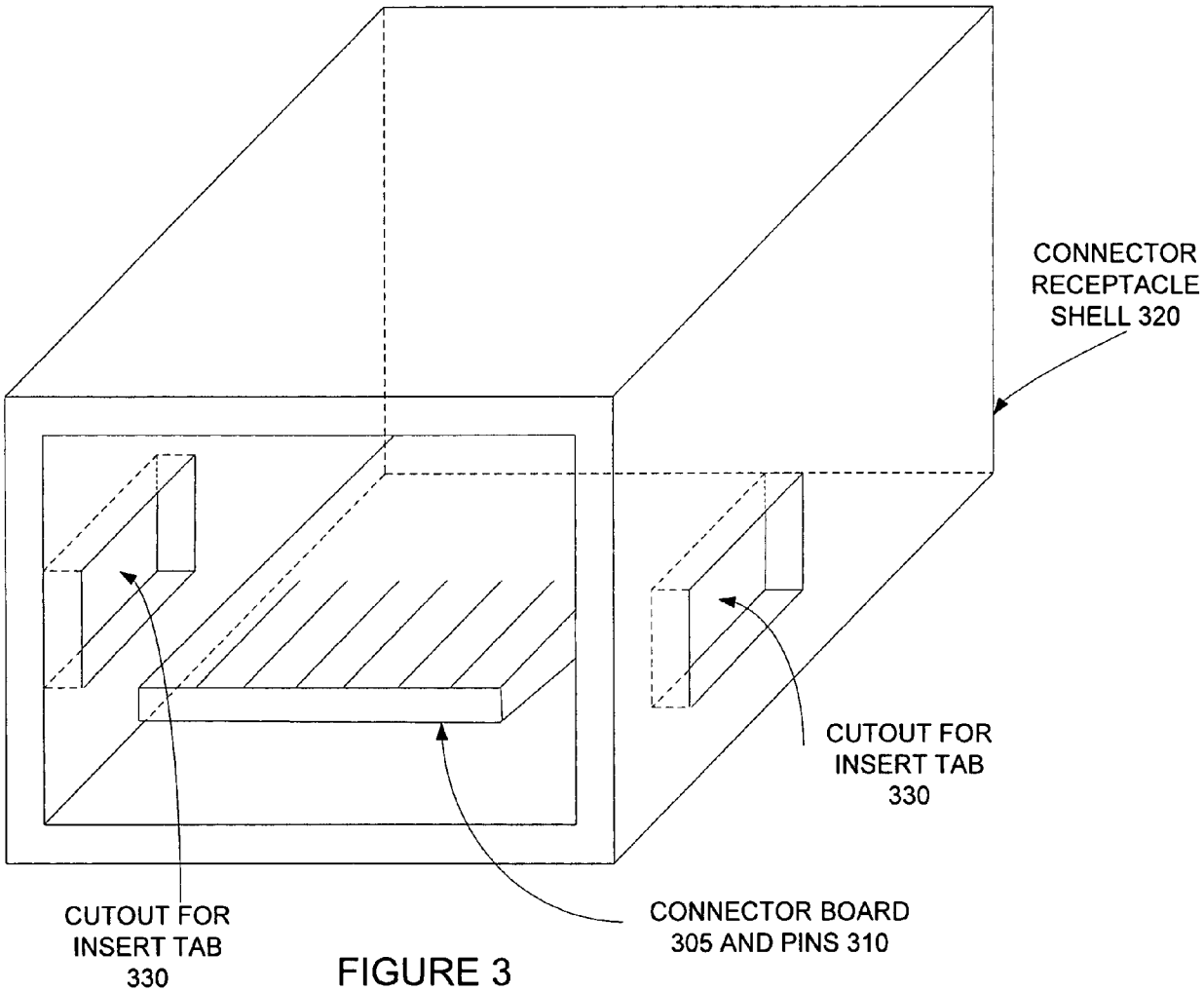
FIG. 3 illustrates further details of a connector receptacle according to an embodiment of the present invention.

FIG. 3 illustrates further details of a connector receptacle according to an embodiment of the present invention. This connector receptacle includes a connector board 305 and pins 310. The pins may be surface mount traces on the board. When a connection is made, the connector board inserts into a slot on the connector insert. Pins on the board make contact pins on the connector insert, thus making an electrical connection between the media player and a cable or dock station. In one embodiment, the connector includes a shell 320 made of conductive material to reduce electromagnetic interference (EMI) when the connectors carry electrical signals.

In one embodiment, the pins 310 are affixed to a bed of a dielectric material of the circuit board 305, leaving a cavity in the remaining portion of the connector interior. In one embodiment the bed of dielectric material can accommodate 30 pins. While the dielectric bed may accommodate 30 pins, the actual number of conductive pins included in the dielectric bed can vary depending on the application.

The connector receptacle further includes cutouts 330 for insert tabs. This specific example shows a cutout on each of two sides of the connector receptacle. The connector insert has tabs on its side. As the connector insert is inserted into the connector receptacle, these tabs compress or deform. When the connector insert is fully seated, the insert tabs release and snap into the insert tab cutout. To prevent accidental removal, the tabs may be arrow shaped to ease insertion but prevent removal. That is, a tab may present a sloped edge when being inserted and a flat edge orthogonal to the connector insert when being removed. To remove the connector, buttons on one or more sides of the connector housing are depressed. This retracts the connector insert tabs and allows the connector insert to be removed.

It is desirable that a user not be able to incorrectly insert a connector insert into a connector receptacle. Doing so may physically damage the connector board, or electrically damage the circuitry that is connected to the pins in the insert or receptacle. For this reason, when the connector insert is inserted upside down, a resistance should be provided such that the user has tactile feedback that the connector is being inserted incorrectly. Accordingly, various embodiments of the present invention include one or more keys to block an incorrect insertion. These keys are shown in the following figure.

Figure 4:
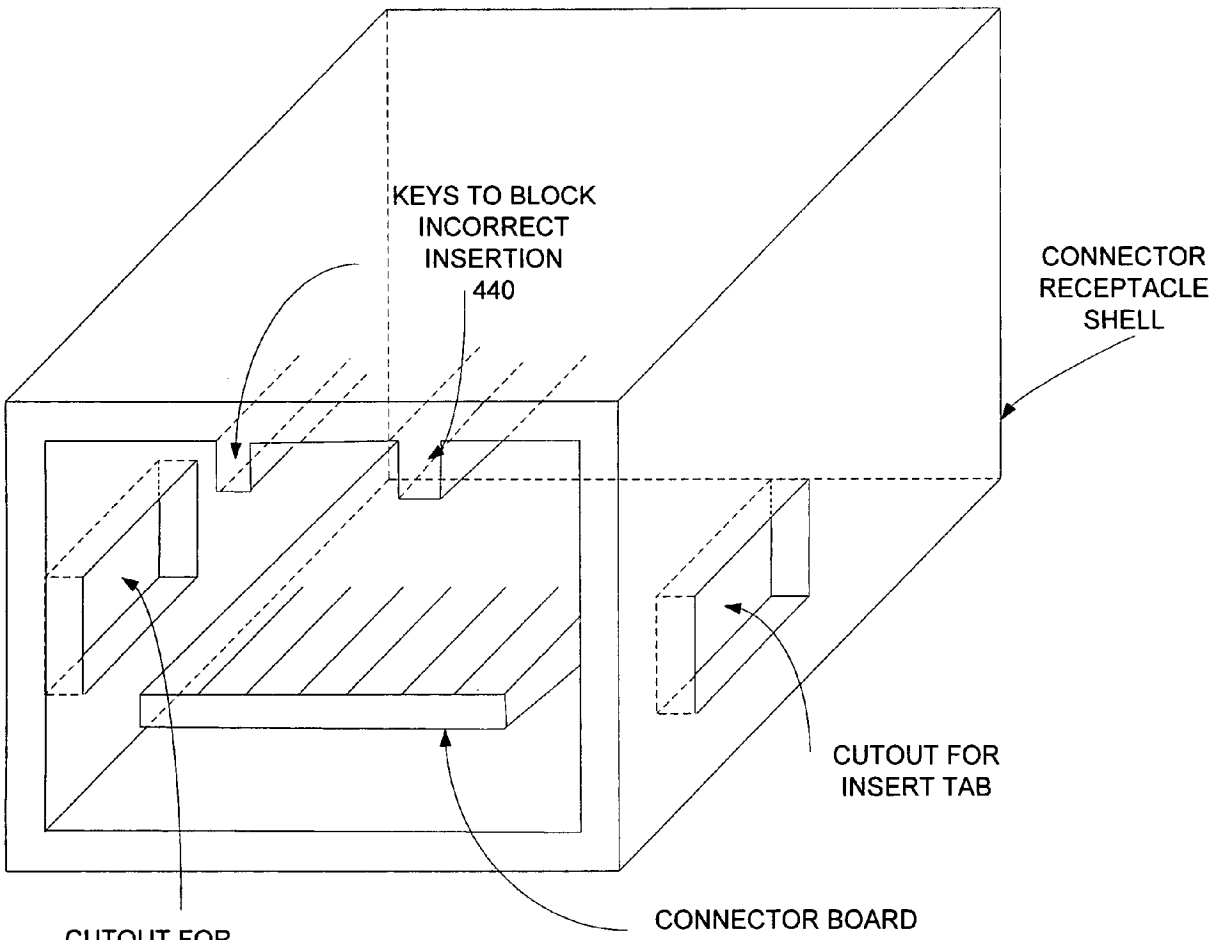
FIG. 4 illustrates a connector receptacle including cutouts for insert tabs and keys to block incorrect insertions according to an embodiment of the present invention.

FIG. 4 illustrates a connector receptacle including cutouts for insert tabs and keys to block incorrect insertions according to an embodiment of the present invention. As shown here, the keys 440 are formed at the top of the connector receptacle, though they may be located on the bottom or sides. These keys correspond to slots or cutouts on the top of the connector insert. For example, the top of the connector insert may be narrower than its bottom such that the narrower portion avoids the keys when inserted. When the connector insert is inserted correctly, the keys fit in the slots of the insert and the insert may be inserted to the connector receptacle. When the connector insert is inserted upside down, the keys block the further insertion of the connector insert. This provides feedback to the user that the connector insert is being inserted improperly, thus protecting the connector board, its pins, and associated circuitry.

A specific media player that may be improved by embodiments of the present invention includes a subassembly portion, a tube or housing portion, and an endcap portion. During assembly, the subassembly portion is inserted into a top end of the tube portion. The endcap portion is then inserted into or attached to a bottom end of the tube portion. The subassembly may include a connector shell, printed circuit board, battery, and LCD. The tube portion may include a tube-like or other type of housing, a window for viewing the LCD, and a click wheel assembly. In other embodiments of the present invention, the tube or other type of housing may include one or more buttons, antennas, LCDs, touch-sensors, or other internal or external components. In conventional media players, it can be difficult to insert the subassembly into the tube or other type of housing portion. This may be due to the height of the connector shell. Specifically, the connector shell can, at least on occasion, strike the bottom of the click wheel, buttons, antennas, LCDs, touch-sensors, or other circuitry or components, damaging portions of the device, and thereby decreasing assembly yield or causing premature device failure. Accordingly, embodiments of the present invention provide connector shells that can be inserted into a tube or other housing without damaging the tube or housing and its associated components. An example is shown in the following figure.

Figure 5:
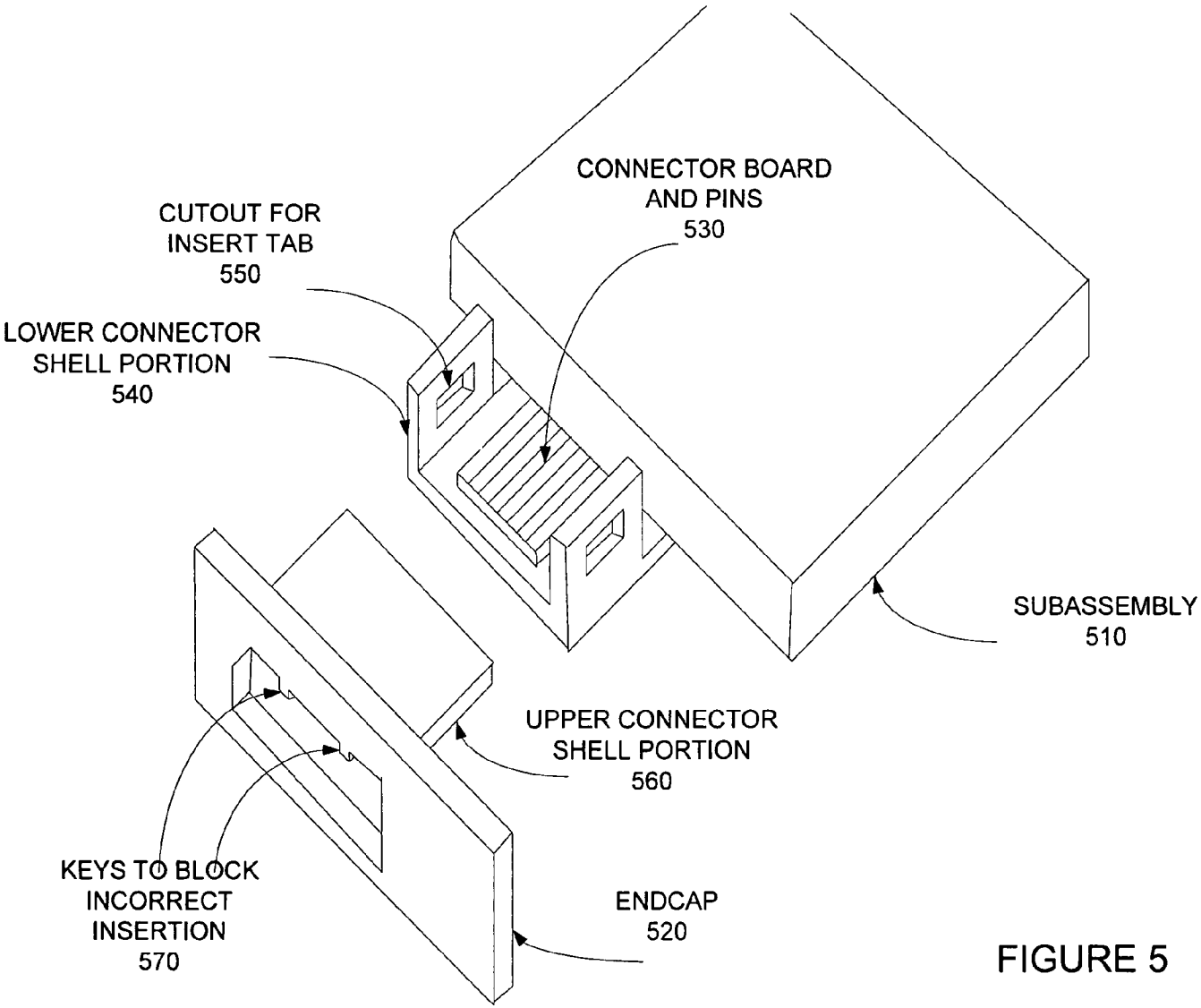
FIG. 5 illustrates portions of a media player according to an embodiment of the present invention.

FIG. 5 illustrates portions of a media player according to an embodiment of the present invention. This figure illustrates a subassembly 510 and an endcap 520. The subassembly 510 is connected to a connector board 530 that has a number of pins on it. A lower connector shell portion 540 is also attached to the subassembly 510. This lower connector shell portion 540 includes sides having cutouts 550 for insert tabs. The endcap 520 includes or is attached to an upper connector shell portion 560. The endcap and upper connector shell portion may be made either as one, two, or more pieces. The endcap and upper connector shell portion may be made of one piece of plastic, metal, or other material. The upper connector shell portion may also include keys 570 that again are used to block incorrect connector insertions. Alternately, the keys may be formed as part of the endcap, or they may be formed together with the endcap and upper connector shell portion as an integral unit or piece.

In this example, the upper portion 560 of the connector shell is attached to the endcap 520 while the lower portion 540 is attached to the subassembly 510. As the subassembly 510 is inserted into the housing (not shown), the connector shell, now without its upper portion, fits below the click wheel and other components without making contact and causing damage.

In some embodiments of the present invention, the connector shell or connector shell portion is moved vertically towards the bottom of the media player. This provides extra clearance room for the connector shell or connector shell portion when inserted into the housing. However, this is not always feasible or desirable. For example, the connector shell or connector shell portion may not have the clearance room to be moved sufficiently lower. Also, there may be other portions of the housing, components, or circuits that may come into contact with the connector shell or connector shell portion if it is lowered. Moreover, it may be more aesthetically pleasing to have the connector in a certain location. For example, it may be desirable to have the connector centered in the endcap. Lowering the connector shell or connector shell portion may detract from the appearance of the media player.

When a connector insert is inserted into the opening of the endcap 520, it is desirable that pins on the connector are correctly aligned to pins on the connector board. In this example, the mechanical placement of the connector insert in the lateral direction along the front of the connector receptacle is controlled by the vertical portions of the lower connector shell and the cutouts for the insert tabs. Since these portions are connected to the connector board and pins, either directly or via the subassembly, the connector insert aligns properly to the connector board when inserted into the connector receptacle.

Alignment of the keys 570 to a connector insert is not as critical as the alignment of the connector insert to the connector board in the connector receptacle. Accordingly, this embodiment of the present invention includes the keys with the top portion of the connector shell. The top portion of the connector shell is then formed with or attached to the endcap 520. Often, the top portion of the shell and the keys are metal. They may be formed from one piece of metal, or they may be formed from separate pieces. Alternately, one or more of these may be plastic or other material. The endcap can be plastic, though in other embodiments is may be metal or other material. The connector shell lower portion can also be metal, plastic, or other material. The connector shell upper and lower portions may be made of the same material, or they may be made of different materials.

In embodiments of the present invention, some or all of the connector shell may be metal, though some or all of the connector shell may be plastic or other material. The endcap may be plastic, metal, or other material. The keys may also be metal, plastic, or other material. When one or more pieces are metal, they may be grounded to form a shield. Further, a ground connection may be made to a ground pin in either or both the connector insert or connector receptacle.

Figure 6:
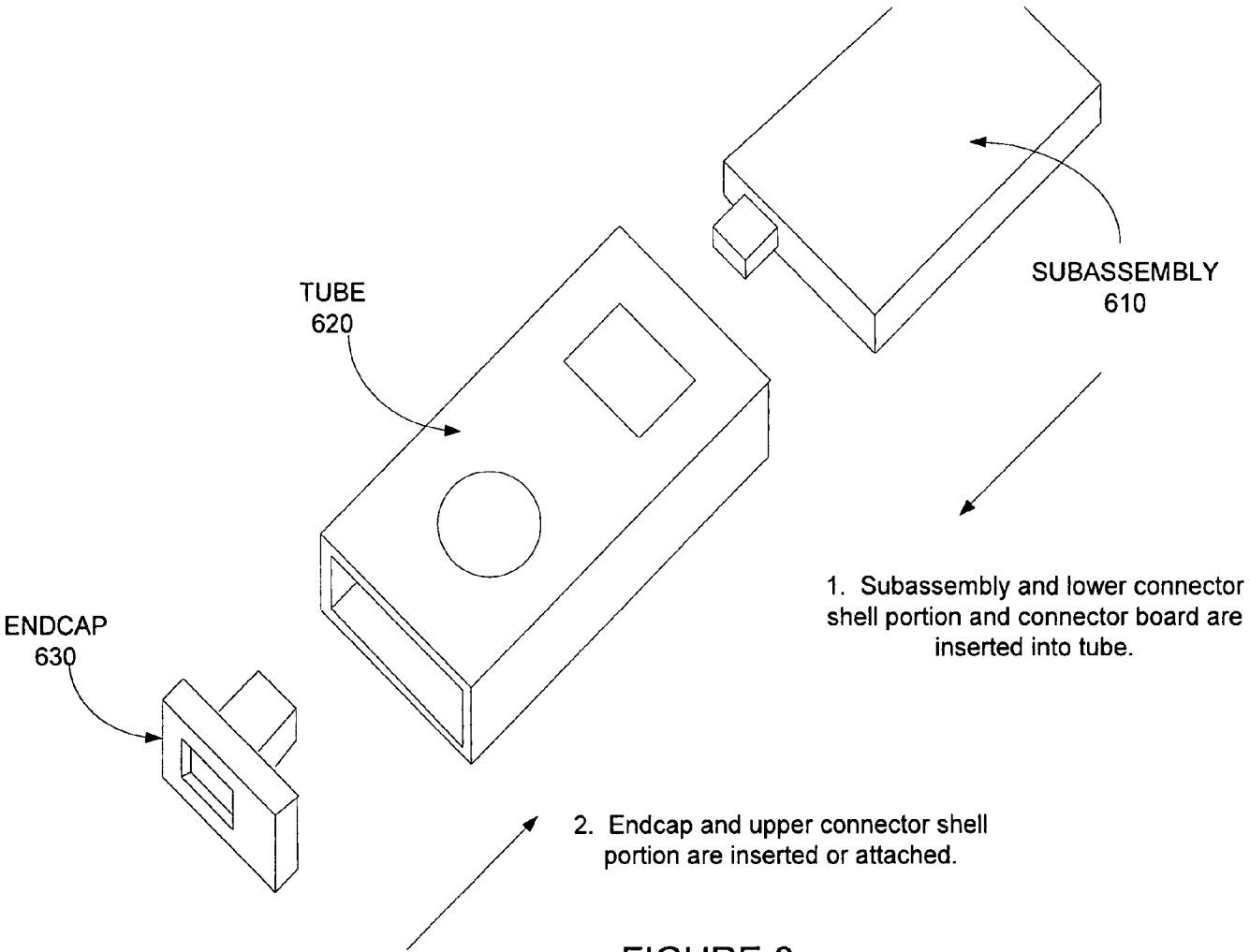
FIG. 6 illustrates a method of manufacturing a media player according to an embodiment of the present invention.

FIG. 6 illustrates a method of manufacturing a media player according to an embodiment of the present invention. This figure includes a subassembly 610, a tube 620, and an endcap 630. The subassembly 610 including the lower connector shell portion and connector board is inserted into the tube from the top. The endcap 630 and upper shell potion are then inserted into, or attached to, the tube from the bottom. The endcap 630 may be secured by gluing, by screws, by stance, or by other means. Again, since the lower assembly portion includes both the board and the cutouts for the connector insert tabs, when the connector insert is inserted into the connector receptacle, the pins of the connector insert correctly aligns to the connector board.

Figure 7:
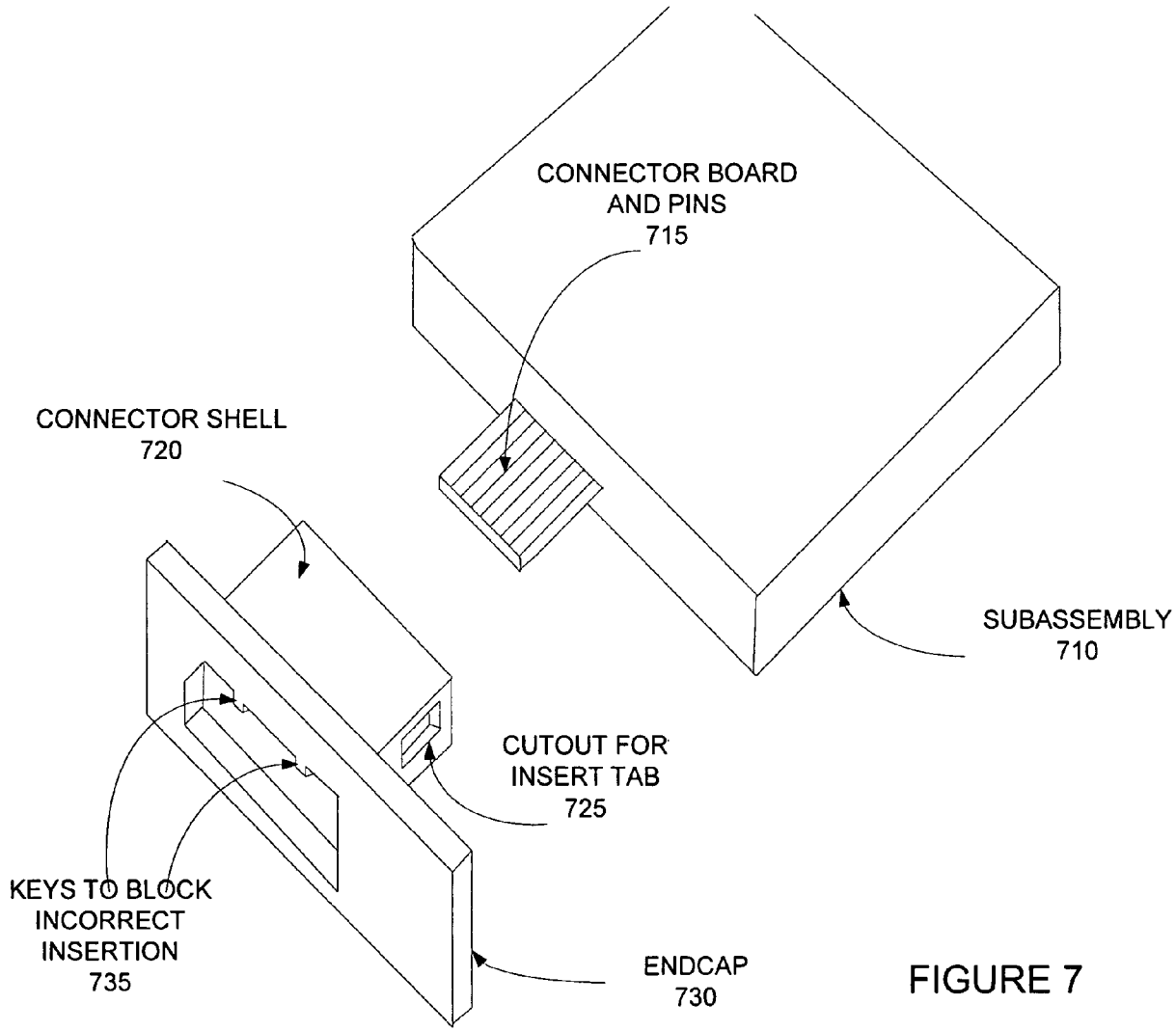
FIG. 7 illustrates portions of another media player according to an embodiment of the present invention.

FIG. 7 illustrates portions of another media player according to an embodiment of the present invention. The endcap 730 includes or is attached to, a connector shell 720 including vertical portions having cutouts 725 for insert tabs. Keys 735 to block incorrect insertions are also included. The subassembly 710 includes or is attached to a connector board and pins 715. As before, the connector shell 720 may be metal, though it may alternately be plastic or other material. In one exemplary embodiment, since the endcap 730 is typically plastic, some or all of the connector shell may also be plastic. Alternately, both the connector shell 720 and endcap 730 may be metal.

Figure 8:
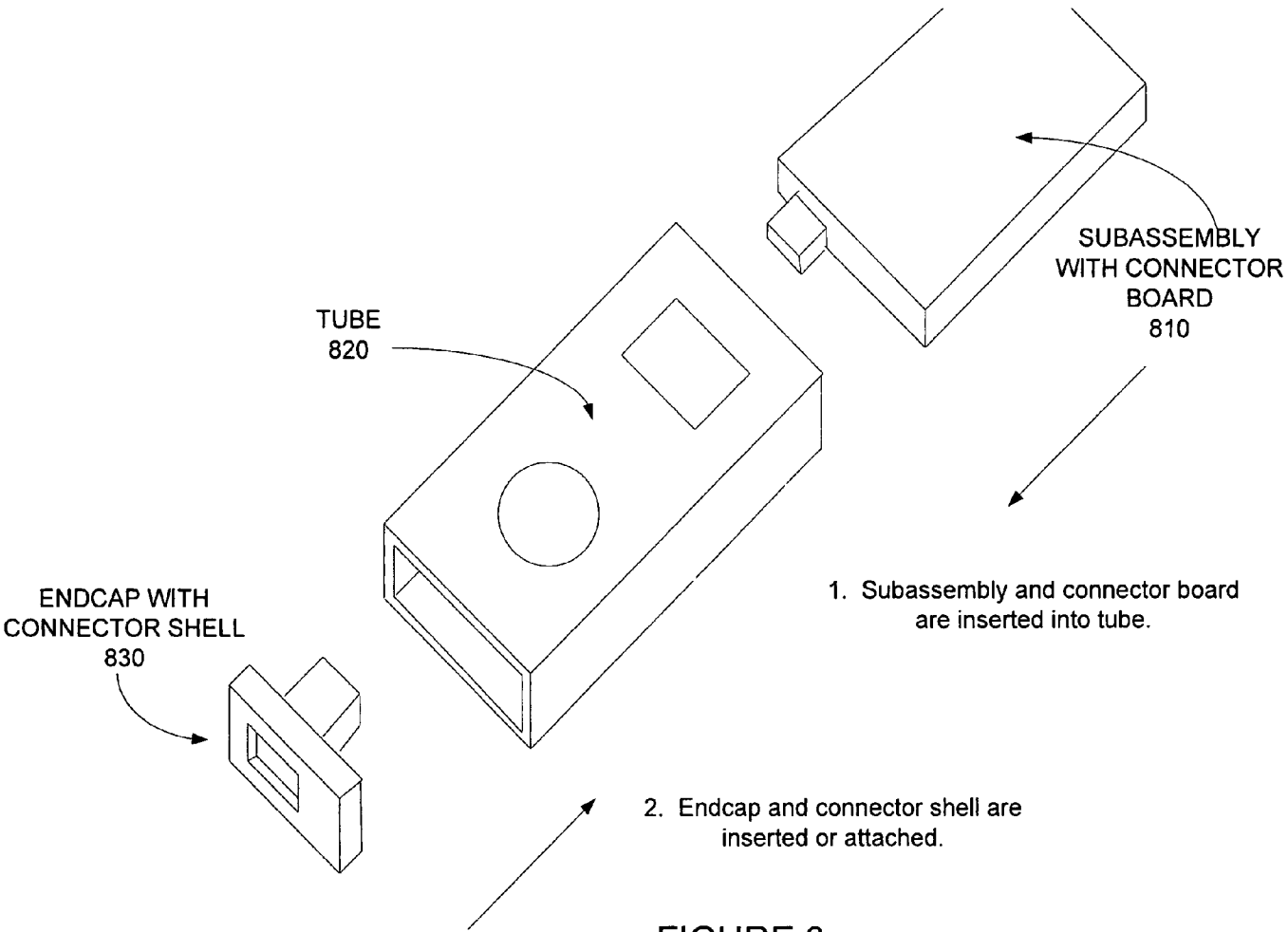
FIG. 8 illustrates a method of manufacturing a media player according to an embodiment of the present invention.

FIG. 8 illustrates a method of manufacturing a media player according to an embodiment of the present invention. A subassembly 810 including or connected to a connector board is inserted into the tube portion 820. Since the connector shell is not attached to the subassembly portion, the subassembly portion 810 fits under the click wheel and other components of the tube without causing damage. The endcap and connector shell 830 can then be inserted into, or attached to, the tube. Again, the endcap may be attached using glue, screws, snaps, or other methods. An example illustrating an attachment using screws is shown in the following figure.

Figure 9:
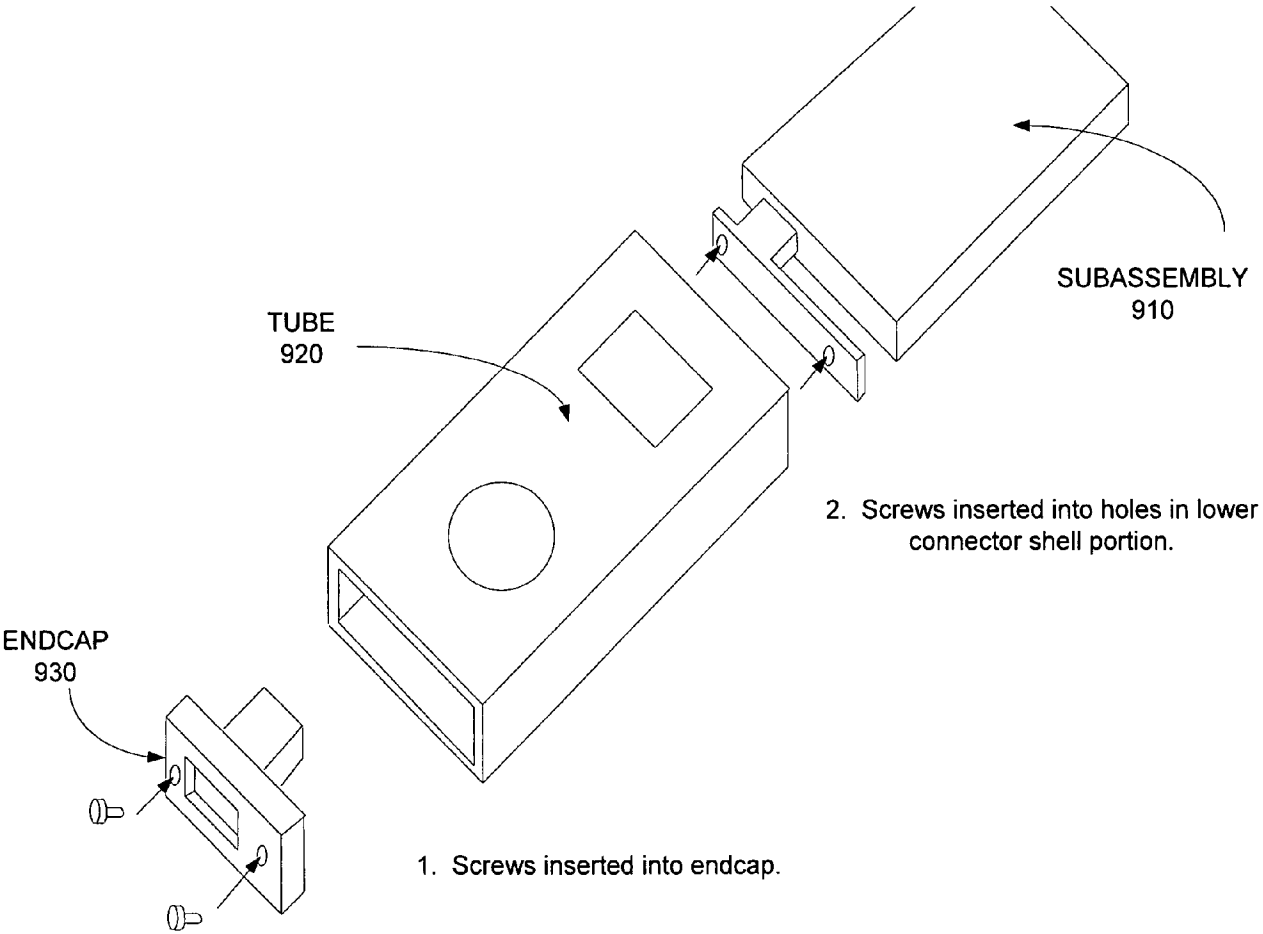
FIG. 9 illustrates a method of assembling a media player according to an embodiment of the present invention.

FIG. 9 illustrates a method of assembling a media player according to an embodiment of the present invention. In this example, the subassembly 910 includes a portion of a connector shell having holes for screws as well as an endcap that also has holes for screws. The subassembly 910 and connector portions are inserted into the tube 920. Again, at least a portion of the connector shell, in this case at least the top portion, is attached to the endcap 930 such that the subassembly 910 fits under the click wheel without causing damage during assembly. The endcap 930 and at least a portion of the connector are then inserted into or attached to the bottom of the tube. Screws are then inserted into the endcap, where they fit into holes on the lower portion of the connector shell that is attached to the subassembly. The screws can then be tightened completing the mechanical connection.

Although a connector was primarily described, it should be appreciated that embodiments the invention are not limited to connectors. For example, the component that is broken up into multiple portions in order to allow proper insertion into the enclosure may be a circuit board assembly where the first portion is the board and chips/circuitry disposed thereon and the second portion is an EMI shield can. In another example, the component may be display assembly where the first portion is a display and the second portion is a frame and/or window of the display. As should be appreciated, any internal component can be broken up in this manner. For example, batteries, I/O, and the like.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. An electronic device comprising:

a housing;

a subassembly within the housing and including a first portion of a connector shell of a connector; and an endcap at an end of the housing and including a second portion of the connector shell, wherein the first portion of the connector shell and the second portion of the connector shell unite to form the connector shell, and wherein the endcap includes an opening through which at least a portion of a corresponding connector of an external device is adapted to be inserted into the connector shell of the electronic device.

2. An electronic device comprising:

a housing having an upper potion and a lower portion;

one or more obstructions connected to the upper portion;

a subassembly including a first portion of a connector shell; and an endcap including a second portion of the connector shell, wherein normal to a surface of the upper portion, a shortest distance from the upper portion to the second portion of the connector shell is smaller than a longest distance from the upper portion to an edge of at least one of the obstructions connected to the upper portion, the surface of the upper portion having a long axis and a short axis, and wherein the at least one of the obstructions resides at a position that overlaps with the second portion of the connector shell on a line along the long axis.

3. The electronic device of claim 1 wherein the endcap and the second connector shell portion are integrally formed.

4. An electronic device comprising:

a housing having an upper portion and a lower portion, wherein one or more components of the electronic device are attached to the upper portion of the housing;

a subassembly connected to a first portion of a connector shell; and an endcap connected to a second portion of the connector shell, wherein the first portion of the connector shell is a lower portion of the connector shell and the second portion of the connector shell is an upper portion of the connector shell, wherein the one or more components include a user interface and a window for viewing a liquid crystal display.

5. The electronic device of claim 1 wherein the subassembly comprises:

a printed circuit board;

a battery;

a liquid crystal display; and a connector board.

6. The electronic device of claim 1 wherein the first portion of the connector shell portion comprises cutouts.

7. The electronic device of claim 6 wherein the cutouts accept tabs on a connector insert when the connector insert is inserted into the electronic device.

8. The electronic device of claim 7 wherein the second connector shell portion comprises one or more keys to prevent improper insertion of a connector insert.

9. The electronic device of claim 7 wherein the endcap comprises one or more keys to prevent improper insertion of a connector insert.

10. The electronic device of claim 1 wherein the housing forms a tube structure.

11. An electronic device comprising:

a housing;

a subassembly within the housing and including a connector board having at least one pin of a connector, wherein the at least one pin is configured to receive a signal from an external device; and an endcap at an end of the housing and including a connector shell of the connector, the connector shell extending from the endcap, wherein the connector shell at least partially covers the at least one pin of the connector, wherein the endcap includes an opening through which at least a portion of a corresponding connector of the external device is adapted to be inserted into the connector shell of the electronic device.

12. The electronic device of claim 11 wherein the housing has an upper portion and a lower portion, wherein one or more obstructions of the electronic device are connected to the upper portion of the housing, and wherein normal to a surface of the upper portion, a shortest distance from the upper portion to the connector shell is smaller than a longest distance from the upper portion to an edge of at least one of the obstructions connected to the upper portion, the surface of the upper portion having a long axis and a short axis, and wherein the at least one of the obstructions resides at a position that overlaps with the connector shell on a line along the long axis.

13. The electronic device of claim 12, wherein the one or more obstructions include a keyboard or touch-pad, or any combination thereof.

14. The electronic device of claim 11 wherein the connector shell surrounds the top, the bottom, and two sides of the connector board.

15. An electronic device comprising:

a housing;

a subassembly within the housing and connected to a connector board having at least one pin of a connector, wherein the at least one pin is configured to receive a signal from an external device; and an endcap connected to a connector shell of the connector, the connector shell extending from the endcap, and the endcap at an end of the housing, wherein the connector shell at least partially covers the at least one pin of the connector, wherein the subassembly comprises:

a printed circuit board;

a battery; and a liquid crystal display.

16. The electronic device of claim 11 wherein the connector shell comprises cutouts.

17. The electronic device of claim 16 wherein the cutouts accept tabs on a connector insert when the connector insert is inserted into the electronic device.

18. The electronic device of claim 17 wherein the connector shell comprises one or more keys to prevent improper insertion of a connector insert.

19. The electronic device of claim 17 wherein the endcap comprises one or more keys to prevent improper insertion of a connector insert.

20. A method of manufacturing an electronic device, the method comprising:

inserting a subassembly and a first portion of a connector shell of a connector into a housing from a first end, the subassembly connected to a circuit board having at least one pin of the connector, and the housing having an upper portion and a lower portion at the time of insertion; and inserting an endcap and a second portion of the connector shell into the housing from a second end, thereby having the second portion placed relative to the first portion to form the connector shell, wherein the second end is different from the first end, and wherein the connector shell surrounds the circuit board at the at least one pin.

21. The method of claim 20, wherein one or more obstructions are connected to the upper portion of the housing, and wherein normal to a surface of the upper portion, a shortest distance from the upper portion to the second portion of the connector shell is smaller than a longest distance from the upper portion to an edge of at least one of the obstructions connected to the upper portion, the surface of the upper portion having a long axis and a short axis, and wherein the at least one of the obstructions resides at a position that overlaps with the second portion of the connector shell on a line along the long axis.

22. The method of claim 21, wherein the one or more obstructions include one or more components of the electrical device, the method further comprising:

before inserting the subassembly, attaching the one or more components to the housing.

23. The method of claim 20 further comprising attaching the endcap with screws.

24. The method of claim 23 wherein the screws fit though the endcap and screw into the first portion of the connector shell.

25. A method of manufacturing an electronic device comprising:

inserting a subassembly and a connector board of a connector into a housing from a first end; and inserting an endcap and a connector shell of the connector into the housing from a second end, wherein the connector shell is configured to at least partially cover the connector board, and wherein the second end is at an opposite end of the housing relative to the first end, the connector shell being adapted to receive a corresponding connector from another electronic device that is at least partially external the housing when the corresponding connector is connected to the connector.

26. The method of claim 25 wherein the housing has an upper portion and a lower portion, and wherein one or more obstructions are connected to the upper portion of the housing, and wherein normal to a surface of the upper portion, a shortest distance from the upper portion to the connector shell is smaller than a longest distance from the upper portion to an edge of at least one of the obstructions connected to the upper portion, the surface of the upper portion having a long axis and a short axis, and wherein the at least one of the obstructions resides at a position that overlaps with the connector shell on a line along the long axis.

27. The method of claim 26, wherein the one or more obstructions include one or more components of the electrical device, the method further comprising:

before inserting the subassembly, attaching the one or more components to the housing.

28. The method of claim 25 wherein the housing forms a tube structure.

29. The method of claim 25 wherein the endcap and connector shell are integrally formed.

30. The electronic device of claim 1, wherein he housing has an upper portion and a lower portion, wherein the subassembly is between the upper portion and the lower portion of the housing, wherein the housing has a first open end at first ends of the upper and lower portions of the housing, and wherein the endcap is at the first open end of the housing such that the external device is adapted to be inserted and removed from the electronic device without removing the endcap.

31. The electronic device of claim 1, wherein the connector shell at least partially surrounds electrical contacts of the electronic device, the electrical contacts adapted to provide a connection interface to the external device.

32. The electronic device of claim 1, wherein the endcap is a final assembly, the second portion of the connector shell being attached to another portion of the end cap.

33. The electronic device of claim 2, wherein the upper portion and the lower portion of the housing are integrally formed.

34. The electronic device of claim 2, wherein the one or more obstructions include one or more components of the electronic device that are attached to the upper portion of the housing.

35. The electronic device of claim 2, wherein the one or more obstructions include internal features of the housing.

36. The electronic device of claim 4, wherein the upper portion and the lower portion of the housing are integrally formed.

37. The electronic device of claim 15, wherein the housing has an upper portion and a lower portion, and wherein normal to a surface of the upper portion, a shortest distance from the upper portion to the connector shell is smaller than a longest distance from the upper portion to an edge of an obstruction connected to the upper portion, the surface of the upper portion having a long axis and a short axis, and wherein the obstruction resides at a position that overlaps with the connector shell on a line along the long axis.

38. The method of claim 20, wherein the first end is opposite the second end.

39. The method of claim 25, wherein the housing has a first dimension longer than the other dimensions of the housing, the first end being at an end of the housing along the first dimension.

40. An electronic device comprising:

a first housing member having at least one open end, the first housing member enclosing at least a first internal component therein;

a second housing member that is mounted relative to the first housing member and that partially closes off the open end of the first housing member;

a connector configured to receive a corresponding connector from another electronic device that is at least partially external to the first housing member and the second housing member when the corresponding connector is received by the connector, the connector including:

at least two separate portions, a first portion being carried by the first internal component, and a second portion being carried by the second housing member, wherein the first portion and the second portion are located relative to each other to form the connector, wherein the first portion is adapted to receive the corresponding connector from the other electronic device.

41. The electronic device of claim 40, wherein the first portion of the connector includes electrical contacts, and wherein the second portion of the connector includes a shell of the connector, the connector shell at least partially surrounding the electrical contacts, and the electrical contacts adapted to provide a connection interface to the another electronic device.

42. The electronic device of claim 40, wherein the first portion of the connector includes a first portion of a shell of the connector and the second portion of the connector includes a second portion of the connector shell.

43. The electronic device of claim 40, wherein the another electronic device is partially external to the first housing member and the second housing member when the corresponding connector is received by the connector.

* * * * *